US007806107B2

(12) United States Patent
Knauβ et al.

(10) Patent No.: US 7,806,107 B2
(45) Date of Patent: Oct. 5, 2010

(54) HAND-HELD POWER TOOL

(75) Inventors: Jens Knauβ, Remshalden (DE); Helmut Zimmermann, Berglen (DE); Markus Keller, Berglen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 12/106,426

(22) Filed: Apr. 21, 2008

(65) Prior Publication Data

US 2008/0276912 A1 Nov. 13, 2008

(30) Foreign Application Priority Data

May 11, 2007 (DE) ..... 10 2007 022 116

(51) Int. Cl.
*F02M 55/02* (2006.01)

(52) U.S. Cl. ..... 123/468; 30/381

(58) Field of Classification Search ..... 30/381; 123/73 AD, 516, 519, 195 R, 198 R; 220/746, 220/4.14, 562; 261/72.1
See application file for complete search history.

(56) References Cited

U.S. PATENT DOCUMENTS

| | | | | |
|---|---|---|---|---|
| 3,372,679 | A * | 3/1968 | Aitken | 123/519 |
| 4,633,843 | A | 1/1987 | Wissmann et al. | |
| 4,782,974 | A * | 11/1988 | Elkayam | 220/86.1 |
| 4,835,816 | A * | 6/1989 | Graef | 16/422 |
| 6,273,070 | B1 * | 8/2001 | Arnal et al. | 123/519 |
| 6,669,043 | B2 * | 12/2003 | Fish et al. | 220/4.14 |
| 7,086,389 | B2 * | 8/2006 | Yamada | 123/516 |

* cited by examiner

*Primary Examiner*—Stephen K Cronin
*Assistant Examiner*—Keith Coleman
(74) *Attorney, Agent, or Firm*—Gudrun E. Huckett

(57) ABSTRACT

A hand-held power tool has at least one operating medium tank having at least one opening. At least one connecting conduit is arranged external to the operating medium tank. At least one connecting member is inserted into the opening, wherein the at least one connecting conduit is connected to the at least one connecting member. Securing devices that secure a rotational position of the at least one connecting member in the opening are provided.

19 Claims, 5 Drawing Sheets

HAND-HELD POWER TOOL

BACKGROUND OF THE INVENTION

The invention relates to a hand-held power tool comprising at least one reservoir or tank for an operating medium. The tank has at least one opening to which at least one connecting conduit arranged external to the tank is connected. At least one connecting member is provided that is inserted into the opening and to which the connecting conduit is connected to the connecting member.

U.S. Pat. No. 4,633,843 discloses a power tool in which a venting valve is provided on a fuel tank. External to the fuel tank, the venting valve is connected by a conduit to the carburetor.

SUMMARY OF THE INVENTION

It is an object of the present invention to provide a hand-held power tool of the aforementioned kind that provides for a compact configuration.

In accordance with the present invention, this is achieved in that securing means for securing a rotational position of the connecting member in the opening are provided.

In case of a hand-held power tool that has a compact configuration, there is only minimal space available for arranging a connecting conduit to the operating medium tank. The connecting lines or connecting conduits must therefore be installed precisely in order to ensure that the connecting conduits in operation will not become damaged. The securing means that secure the rotational position of the connecting member in the opening determine the direction in which the connecting conduit can be guided away from the connecting member. In this way, even for minimum of available space a safe installation of the connecting conduit can be achieved. Wrong installation or a rotation of the connecting member in operation are safely prevented.

The operating medium tank (reservoir) can be a fuel tank or a lubricant tank (reservoir for a lubricating oil). The operating medium tank can also contain other liquids. In the case of a spraying device, the operating medium tank can also be the reservoir for the medium to be sprayed.

Advantageously, on the connecting member securing means are provided that interact with securing means provided on the operating medium tank. Accordingly, no additional components for securing the rotational position are required. The securing means can be produced simply and integrally with the operating medium tank and the connecting member, respectively. A safe installation of the connecting conduit even when only minimal space is available can be achieved when at least one connecting conduit is configured as a shaped hose. In contrast to hose material that is cut to length, a shaped hose has a pre-shaped configuration. It is also possible to provide on the shaped hose connecting elements, seals or the like. Even bends in the hose can be pre-shaped in the shaped hose. In this way, stress on the hose material resulting e.g. from subsequent bending is reduced.

It is provided that the connecting line or conduit is pushed onto a connecting socket of the connecting member. Especially for ensuring that in a configuration of the connecting conduit as a shaped hose the connecting conduit has the desired orientation, it is provided that at least one connecting member has rotational securing means for securing the rotational position of a connecting conduit on the connecting socket. By means of the rotational securing means the relative position of the connecting conduit to the connecting socket of the connecting member is determined. Because securing means for securing the rotational position of the connecting member in the opening are provided also, the relative position and the alignment of the connecting conduit relative to the opening of the housing are fixed. In a simple way the desired orientation of the connecting conduit can thus be ensured.

In particular in the case of an operating medium tank that is provided only with a venting action but not a tank bleeding action, there are increased demands with regard to seal-tightness of the opening of the operating medium tank. In order to achieve high seal-tightness at the opening of the operating medium tank, it is provided that in the opening a seal is arranged into which the connecting member is inserted wherein the connecting member pushes or forces the seal against the rim of the opening. The connecting member widens the seal radially outwardly. The seal is comprised in particular of nitrile rubber (NBR) that swells when in contact with fuel. In case of later drying processes, the seal can shrink. This can lead to leaks. The connecting member inserted into the seal prevents or limits such shrinkage so that no leaks will results. An excellent seal-tightness can be achieved. In comparison to hose conduits that are passed through a seal, the connecting member arranged in the seal and having connected thereto the connecting conduit provides a significantly improved sealing action.

Advantageously, the seal is formed on a line section that extends in the interior of the operating medium tank. A conduit, for example, a fuel line, is therefore comprised advantageously of two sections, i.e., a section arranged within the interior of the tank on which the seal is integrally formed as well as a line section external to the tank that is connected with the line section arranged within the tank by means of a connecting member. It can also be advantageous that this seal is integrally formed on a line section extending external to the operating medium tank.

A suction head for the operating medium is particularly arranged on the line section. The operating medium can be e.g. fuel but the operating medium can also be a lubricant oil. The operating media can also be other liquids that are employed in the use of the power tool, for example, a spraying medium in the case of a spraying device. Advantageously, the line section extending into the interior of the operating medium tank is a shaped hose. The seal has advantageously means for securing the rotational position of the seal in the opening. Accordingly, it is possible in a simple way to secure the orientation of the line section arranged in the interior of the operating medium tank.

Advantageously, a first connecting line or conduit is a fuel line that is connected to the carburetor of the power tool. A second connecting line is in particular a venting line that is connected to a venting valve. The venting valve is in particular arranged on a grip housing of the power tool that is separated by a vibration gap from the operating medium tank. In that the venting valve is arranged on the grip housing of the power tool, the venting valve is vibration-decoupled by means of the vibration gap from the operating medium tank. In this way, minimal vibration loads act on the venting valve. This increases the service life of the venting valve. In that the orientation of the connecting conduit is fixed by the securing means for securing the rotational position of the connecting member in the opening, the connecting line can be passed across the vibration gap in a defined direction. Damage to the connecting conduit as a result of relative movement of the grip housing relative to the operating medium tank in operation can thus be prevented.

Advantageously, a third connecting line can be a purge line (scavenging line) that is connected to a scavenging pump. In particular, a first connecting member is provided for the fuel line and a second connecting member is provided for the venting line. When the power tool comprises a scavenging pump, it is provided in particular that the second connecting member has a first connecting socket for the venting line and a second connecting socket for the purge line. However, it is also possible to provide a common connecting member for the fuel line and the venting line. In particular, all connecting lines or conduits are connected to a common connecting member. In this connection it is advantageous to provide a separate passage for the fuel line through the connecting member.

In order to ensure a defined positioning of the connecting lines, at least one holder for positioning a connecting line is provided on the power tool. A holder can be, for example, integrally formed on the housing of the power tool or in the grip housing of the power tool. This provides a simple configuration.

DESCRIPTION OF THE PREFERRED EMBODIMENTS

Figure 1:
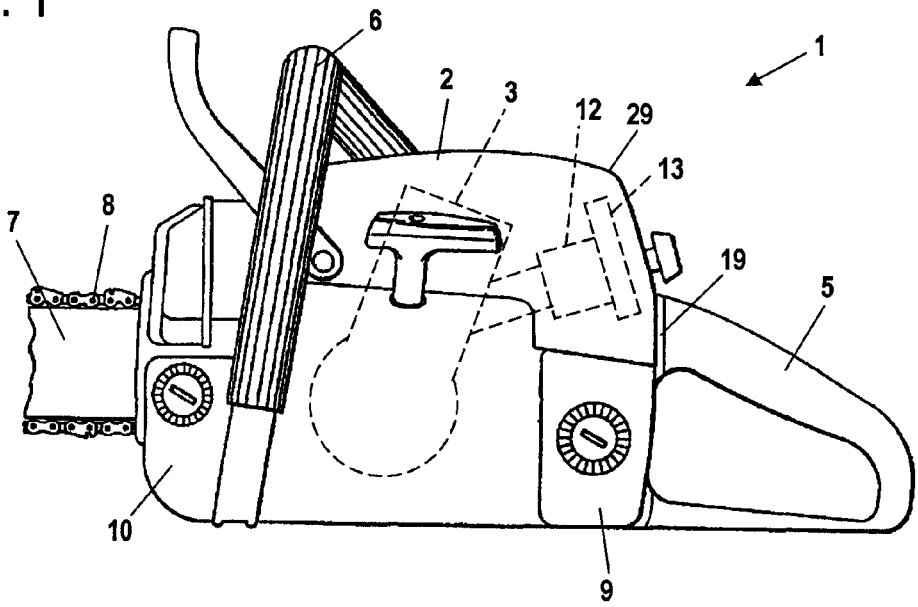
FIG. 1 is a schematic side view of a motor chainsaw.

FIG. 1 shows as an embodiment of a hand-held power tool a motor chain saw. The motor chainsaw 1 has a housing 2 in which a drive motor 3 is arranged. The drive motor 3 drives in circulation a saw chain 8 about a guide bar 7. The drive motor 3 is a single-cylinder internal combustion engine. The drive motor 3 is in particular a two-stroke engine or a mixture-lubricated four-stroke engine. The drive motor 3 is connected to a carburetor 12 through which the drive motor 3 takes in fuel/air mixture. At the inlet into the carburetor 12 an air filter 13 is arranged. A rear handle 5 as well as a grip pipe 6 are secured on the housing 2. The rear handle 5 and the grip pipe 6 are separated from the housing 2 and the drive motor 3 by means of vibration-damping elements so that the rear handle 5 and the grip pipe 6 are vibration-decoupled from the drive motor 3. The motor chainsaw 1 has two operating medium tanks (reservoirs), i.e., a fuel tank 9 that supplies fuel to the carburetor 12 as well as a lubricant tank 10 from which lubricant oil is conveyed to the saw chain 8 for lubricating the saw chain 8.

Figure 2:
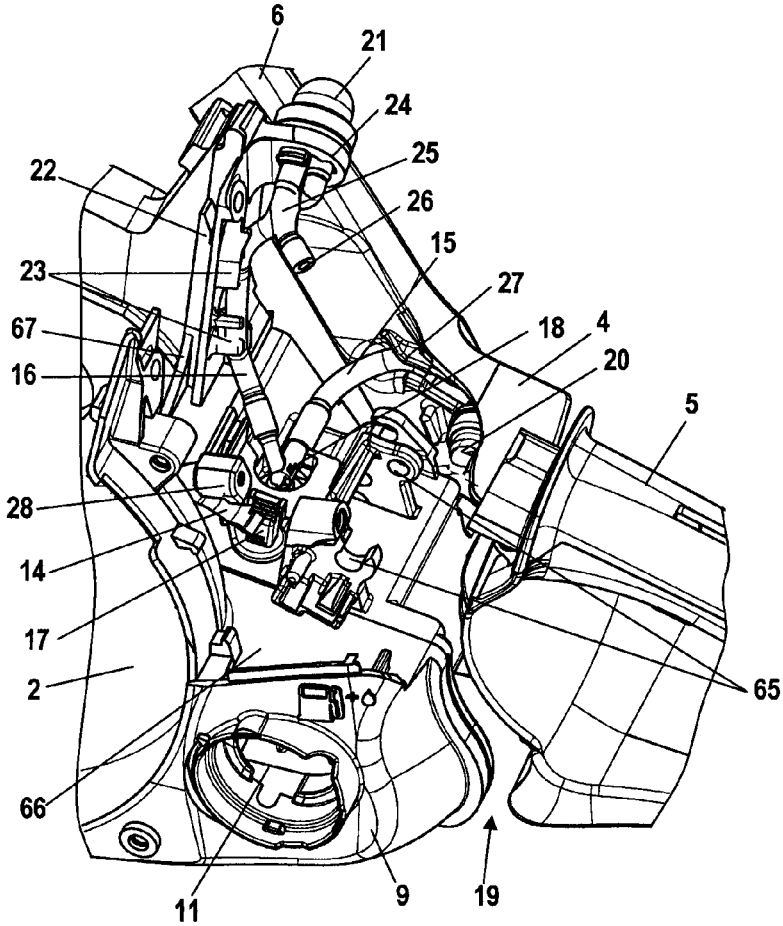
FIG. 2 is a perspective detail view of the topside of the fuel tank of the motor chainsaw of FIG. 1.

FIG. 2 shows the motor chainsaw 1 in the area of the rear handle 5 and the fuel tank 9. In FIG. 2, the carburetor box lid 29 shown in FIG. 1 is removed and the carburetor 12 as well as the air filter 13 (see FIG. 1) are not illustrated. The rear handle 5 is connected fixedly to the grip pipe 6 and both together form a grip housing 4. The grip housing 4 is separated from the housing 2 by means of a vibration gap 19 shown in FIG. 1, which gap enables relative movements between the grip housing 4 and the housing 2. The vibration gap 19 is bridged by antivibration elements that are well known in the art and therefore not illustrated. The fuel tank 9 is integrally formed with the housing 2. On the topside of the fuel tank 9 bearing elements 65 for supporting operating elements for the carburetor 12 are arranged. The fuel tank 9 has a fill opening 11 through which fuel is filled into the fuel tank 9. For removing fuel from the fuel tank 9, a fuel line 14 is connected to the topside 66 of the fuel tank 9 which topside 66 is facing the carburetor 12. The fuel line 14 is connected to the interior of the fuel tank 9 by means of a first connecting member 17. The fuel line 14 has at the end facing away from the connecting member 17 a connecting nipple 28 for attaching a fuel pump of the carburetor 12. By means of the fuel line 14 fuel is supplied to the carburetor 12.

On the topside 66 of the fuel tank 9 a second connecting element is arranged to which a venting line 15 and a purge line 9 are connected. The venting line 15 is connected to a venting valve 20. The venting valve 20 is secured on the grip housing 4. In this way, the venting valve 20 is vibration-decoupled from the fuel tank 9. The venting line 15 crosses the vibration gap 19. In the grip housing 4 a holder 27 is provided in which the venting line 15 is guided or secured.

The purge line 16 is connected to a scavenging pump 21. The scavenging pump 21 serves or returning fuel from the control chamber of the carburetor 12 to the fuel tank 9. In this way, vapor bubbles that can be generated upon extended shutdown of the motor chainsaw 1 in the carburetor 12 can be removed from the control chamber. The housing 2 has a housing wall 22 that spatially separates the carburetor 12 from the drive motor 3. The housing wall 22 has a penetration or passage 67 for an intake of the drive motor 3. The scavenging pump 21 is arranged in a receptacle 24 that is integrally formed in the housing wall 22. The purge line 16 is secured between the second connecting member 18 and the scavenging pump 21 in several holders 23 that are integrally formed on the housing wall 22. In this way, the position of the purge line 16 is safely defined. From the scavenging pump 21 an intake line 25 extends to the carburetor 12 and has a connector 26 for connecting it to the carburetor 12.

Figure 3:
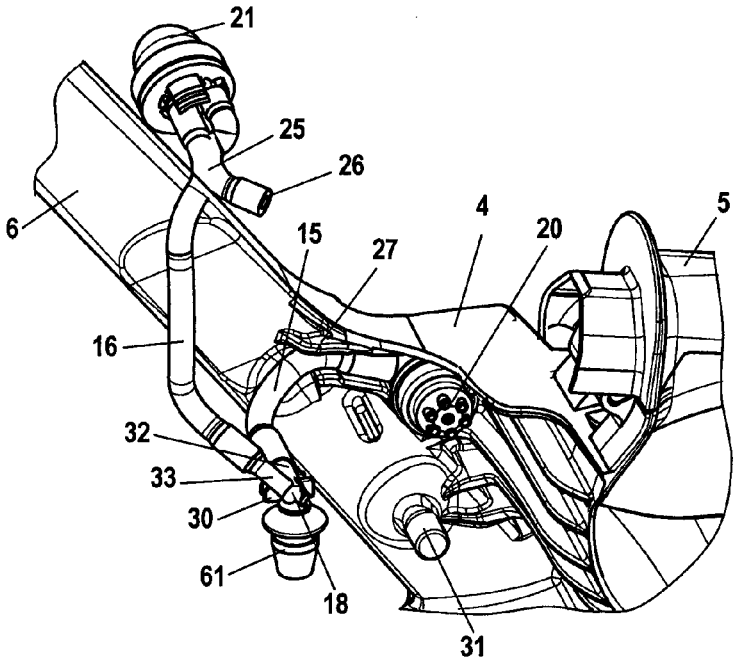
FIG. 3 is a perspective detail view of the grip housing as well as of the venting line and the purge line of the motor chainsaw.

FIG. 3 illustrates the grip housing 4 in the area of the venting valve 20. On the grip housing 4 a holder 31 is integrally formed in the area between the rear handle 5 and the grip pipe 6 on which holder an antivibration element or a stop (not shown) for limiting a relative movement between the housing 2 and the grip housing 4 is arranged. As shown in FIG. 3, the venting line 15 extends in a curved shape between the venting valve 20 and a first connecting socket 32 of the second connecting member 18 onto which socket the venting line 15 is pushed. In order to avoid damage to the venting line 15 as a result of relative movement occurring in operation between the grip housing 4 and the housing 2, the venting line 15 must be arranged in a precisely defined position. In order to ensure this, the second connecting member 18 has positional securing means 30 (see FIGS. 8 and 9 for details) that secure the rotational position of the connecting member 18 on the tank housing. In this way, the alignment of the first connecting socket 32 is fixed. The purge line 16 is pushed onto a second connecting socket 33. Its alignment is also precisely fixed by means of the positional securing means 30.

Figure 4:
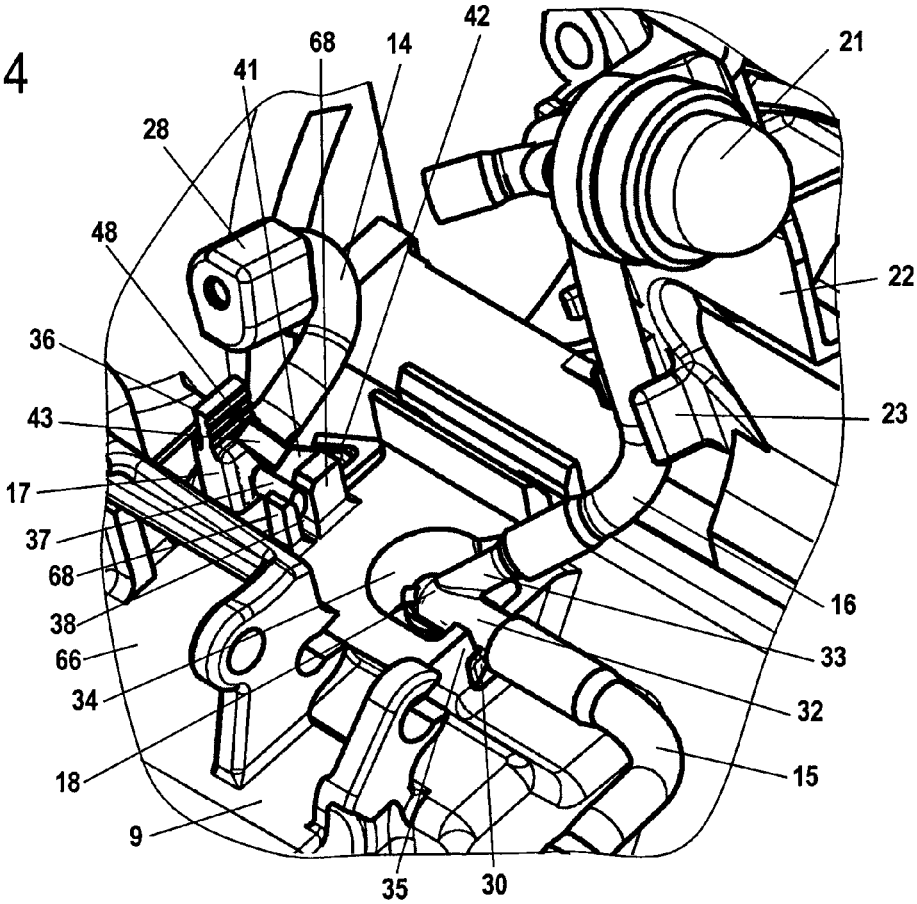
FIG. 4 is a perspective detail view onto the tank housing of the motor chainsaw.

FIG. 4 shows that the positional securing means 30 rests against a wall section 35 of the housing 2. The second connecting member 18 is arranged in a recess 34 on the topside 66 of the fuel tank 9. The wall section 35 delimits the recess 34 on one side of the recess 34. By arranging the positional securing means 30 on the wall section 35, the second connecting member 18 can be arranged only in one particular orientation.

As shown in FIG. 4, the first connecting member 17 also has a positional securing means 37 that secures the rotational position of the first connecting member 17 on the topside 66 of the fuel tank 9. On the housing 2 on the topside 66 of the fuel tank 9 wall sections 68 are integrally formed between which a receptacle 38 for the positional securing means 37 is formed. In the illustrated embodiment the wall sections 68 extend only about a minimal circumferential area of the second connecting member 17. However, it can also be provided that the wall sections 68 extend about the entire circumference of the connecting member 17 so that an alignment of the first connecting member 17 is possible only in one way. In the illustrated embodiment, the wall sections 68 secure the rotational position of the first connecting member 17 in a partial angular range. The partial angular range is designed such that the connecting nipple cannot be connected to the carburetor 12 28 when the securing means 37 is outside of the receptacle 38 so that an erroneous installation is immediately recognized.

FIG. 4 shows that the first connecting member 17 has a gripping section 36 where the connecting member 17 can be held, for example, by means of pliers. For this purpose, the gripping section 36 has a rough surface; in the illustrated embodiment it is in the form of grooves.

Figure 5:
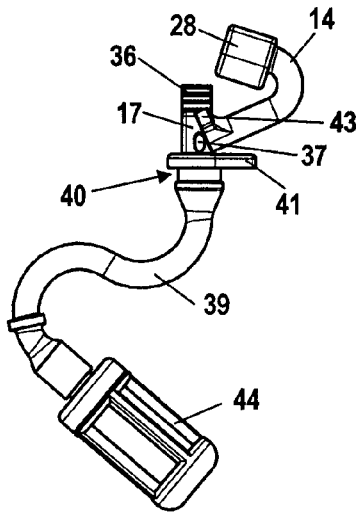
FIG. 5 is a side view of the fuel line of the motor chainsaw of FIG. 1.
Figure 6:
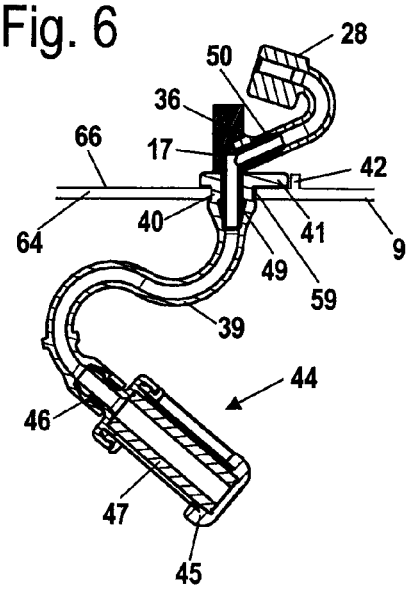
FIG. 6 is a section illustration of the fuel line of FIG. 5.

As shown in FIGS. 5 and 6, the connecting member 17 is inserted into a seal 40. The seal 40 is inserted into an opening 59 of a wall 64 of the fuel tank 9. The connecting member 17 has for this purpose a first connecting socket 49. The first connecting socket 49 widens the seal 40 radially outwardly and presses the seal 40 against the rim of the opening 59. In this way, an excellent sealing action at the opening 59 is ensured. As shown in FIGS. 5 and 6, a line section 39 is integrally formed on the seal 40 and projects into the interior of the fuel tank 9. On the free end of the line section 39 a suction head 44 is secured. The suction head 44 has a housing 45 with a connecting socket 46 that is inserted into the line section 39. In the suction head 44 a filter insert 47 is arranged. The line section 39 is a shaped hose and has an approximately S-shaped configuration. In order to ensure that the line section 39 is arranged correctly on the fuel tank 9, the seal 40 is provided with a positional securing means 41 that is also illustrated in FIG. 4. The positional securing means 41 is in the form of an outwardly projecting section of the edge of the seal 40 that is otherwise of a circular shape. The positional securing means 41 is positioned in a receptacle 42 of the topside of the fuel tank 9. In this way, the rotational position of the seal 40 with the line section 39 in the interior of the fuel tank 9 is fixed. The correct rotational position of the line section 39 with the suction head 44 ensures that the suction head 44 in operation, when turning the motor chainsaw 1, drops into a deeper area of the fuel tank 9 in which, even at a low filling level of the fuel tank 9, there is still fuel present. The correct alignment of the line section 39 provides the desired drop behavior of the suction head 44.

Figure 7:
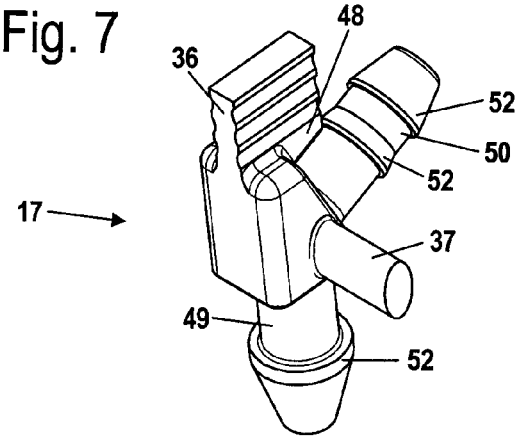
FIG. 7 is a perspective illustration of a first embodiment of a connecting member of the motor chain saw.

As shown in FIGS. 4 to 6, the fuel line 14 has at its end that is pushed onto the first connecting member 17 a connecting rim 43. The fuel line 14 is pushed onto a second connecting socket 50 of the first connecting member 17. The connecting rim 43 is positioned on both sides of the rotational securing means 48 as shown in FIG. 7. For this purpose, the connecting rim 43 has a slot into which the rotational securing means 48 project. In this way, the rotational position of the fuel line 14 is secured on the second connecting socket 50 of the first connecting member 17. The connecting rim 43 extends across a partial angular area of the circumference of the fuel line 14. The partial angular area is designed such that the connecting nipple 28 cannot be mounted on the carburetor 12 when the rotational securing means 48 is located outside of the connecting rim 43 and is not positioned in the slot of the connecting rim 43. In this way, erroneous installation is prevented. By means of the positional securing means 41 of the seal 40, the positional securing means 37 of the first connecting member 17, and the rotational securing means 48 of the first connecting member 17, the position of the line section 39, the position of the first connecting member 17, and the position of the fuel line 14 relative to the housing 2 are fixed.

As shown in the perspective illustration of FIG. 7, the first connecting member 17 is provided on the first connecting socket 49 as well as on the second connecting socket 50 with circumferential beads 52 that are configured as a "fir tree fitting" and that prevent the connecting lines from accidentally slipping off the connecting sockets 49, 50. The two connecting sockets 49, 50 have different diameters. The gripping section 36 ensures that only the connecting socket 49 can be inserted into the seal 40. Insertion of the connecting socket 50 into the seal 40 is not possible as a result of the geometry of the gripping section 36. In this way, a leak at the seal 44 that could be caused by insertion of the smaller connecting socket 50 is prevented.

Figure 8:
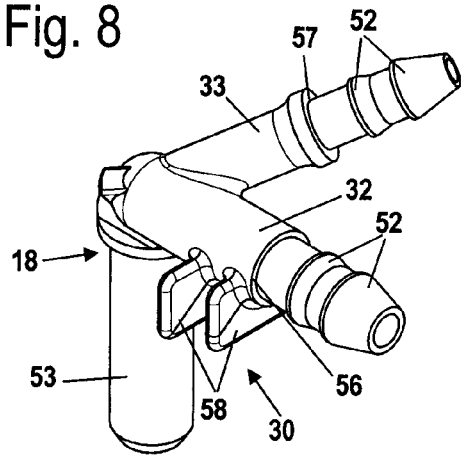
FIG. 8 is a perspective illustration of a second embodiment of a connecting member of the motor chain saw.
Figure 10:
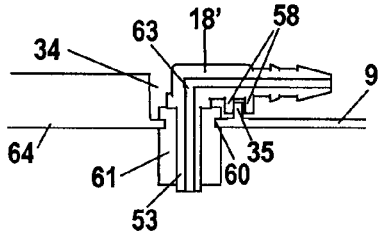
FIG. 10 shows the connecting member of FIG. 9 inserted in the opening of the fuel tank in a schematic section illustration.

In FIG. 8, the second connecting member 18 is illustrated. The second connecting member 18 has a socket 53. As shown in FIG. 10, the socket 53 projects into a seal 61. The seal 61 is arranged in an opening 68 of the wall 64 of the fuel tank 9. By means of the socket 53 the seal 61 is widened and pressed against the rim of the opening 60 so that the opening 60 is sealed tightly. FIG. 10 shows the arrangement of the seal 61 for a connecting socket 18' that will be explained in more detail in the following. As shown in FIG. 8, the first connecting socket 32 of the second connecting member 18 has also circumferential beads 52. Also, on the second connecting socket 33 circumferential beads 52 are provided. On the second connecting socket 33 a stop 56 is provided and on the first connecting socket 32 a stop 57 is provided. The stops 56 and 57 delimit the insertion depth of the connecting conduit onto the connecting socket 32, 33. As shown in FIG. 8, the positional securing means 30 has first securing elements in the form of two stays 58 that are formed integrally at a spacing relative to one another on the second connecting socket 33. As shown in FIG. 10 for the connecting socket 18', the two stays 58 are arranged on both sides of the wall section 35 providing second securing elements interacting with the stays and in this way fix the rotational position of the connecting socket 18, 18'. This stay 58 that is facing the socket 53 is arranged in the recess 34 illustrated in FIG. 4. The width of the stay 58 is selected such that it corresponds approximately to the width of the recess 34 in the area in which the stay 58 is arranged. Thus, the rotational position of the connecting socket 18 in the opening 60 is precisely defined.

Figure 9:
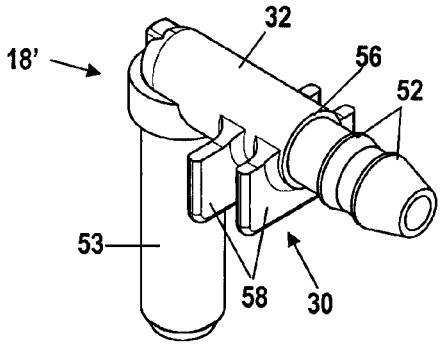
FIG. 9 is a perspective illustration of a third embodiment of a connecting member of the motor chain saw.

In FIG. 9 an embodiment for a second connecting member 18' is illustrated. The second connecting member 18' has only a first connecting socket 32 for connection to a venting line 15. The connecting member 18' is designed for motor chainsaws 1 that do not have a scavenging pump 21. In other respects, the connecting sockets 18 and 18' are identically embodied and arranged.

Figure 11:
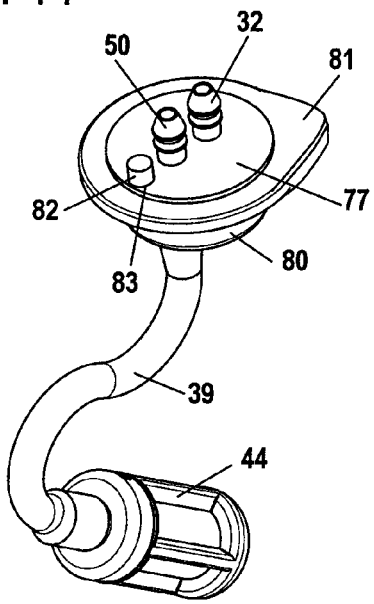
FIG. 11 is a perspective illustration of the connecting member in a seal.
Figure 12:
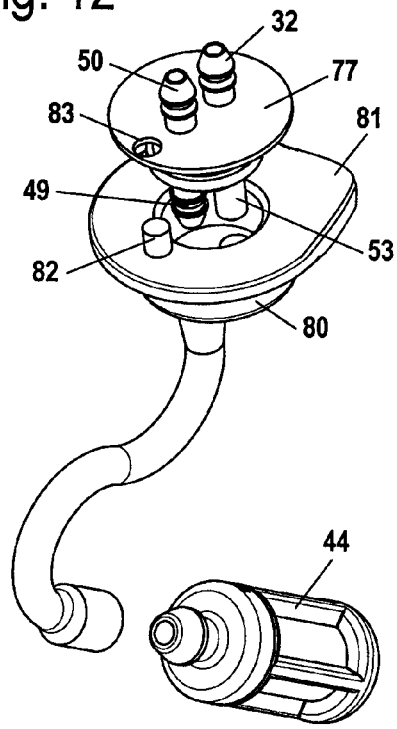
FIG. 12 shows the connecting member with the seal of FIG. 11 in an exploded view.
Figure 13:
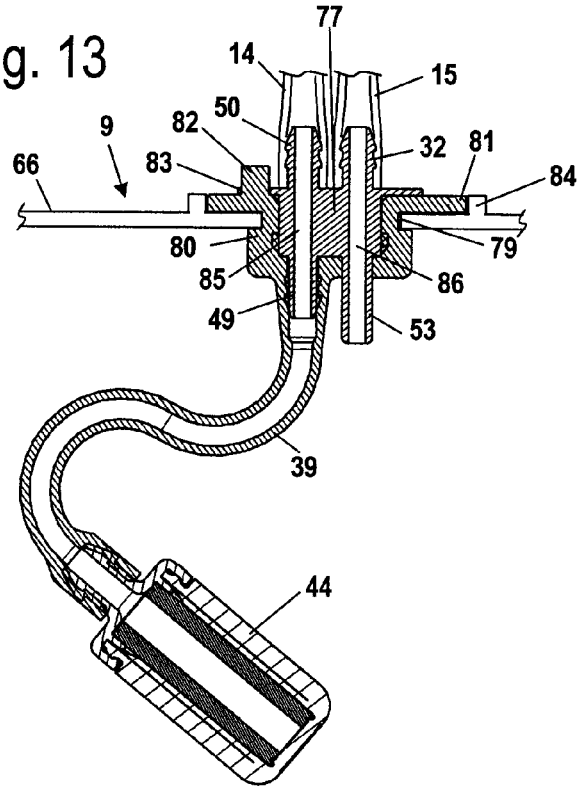
FIG. 13 is a section illustration of the connecting member with the seal arranged in an opening of the operating medium tank.

It can also be provided that a single connecting member for attaching the fuel line, the venting line and, in addition, optionally also a purge line is provided. This is illustrated in FIGS. 11 to 13. For this purpose, a connecting member 77 is provided on which a first connecting socket 32 for attachment of a venting line 15 and a second connecting socket 54 for attachment of a fuel line 14 are provided The connecting member 77 is inserted into a seal 18 that is formed integrally on the line section 39. In FIGS. 11 to 13 same reference numerals corresponds to the same components as in FIGS. 1 to 10.

On the seal 80 a positional securing means 82 is provided that is embodied as an upwardly projecting bolt that projects into a receptacle 83 in the connecting member 77. In this way, the alignment of the connecting socket 77 in the seal 80 is fixed. On the seal 80 there is also a positional securing means 81 that is configured as an outwardly projecting section of the otherwise circular contact surface of the seal 80 on the fuel tank 9.

As shown in the section illustration of FIG. 13, the positional securing means 81 is adjacent to wall section 84 integrally formed on the fuel tank 9. The wall section 84 is advantageously embodied so as to extend circumferentially about the seal 80 and thus fixes the position of the seal 80 and of the line section 39 on the fuel tank 9.

As shown in FIG. 13, on the connecting member 77 a first connecting socket 49 is formed that projects into the interior of the tank and that adjoins the line section 39. The connecting member 77 is penetrated by a passage 85 that connects the line section 39 to the fuel line 14 arranged on the connecting socket 50 as schematically shown in FIG. 13. A socket 53 extends into the interior of the fuel tank 9; the socket 53 is connected by passage 86 to the connecting socket 32 and is connected to the venting line 15 secured on the connecting socket 32. The passages 85 and 86 extend separately through the connecting member 77. In addition, a further connecting socket for a purge line 16 can be connected to the socket 53.

The seal 80 is arranged in an opening 79 of the fuel tank 9. The seal 80 is widened by the connecting member 77 inserted into the seal 80 and is pressed against the rim of the opening 79. In this way, shrinkage of the seal 80 is prevented or at least maintained within narrow limits.

Figure 14:
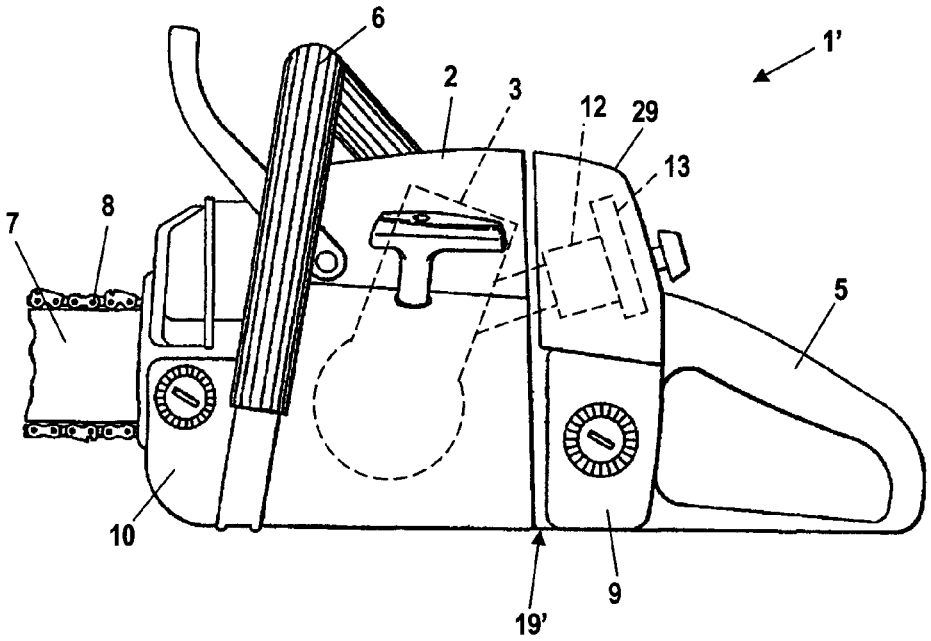
FIG. 14 is a first embodiment of a hand-held power tool in a schematic side view.
Figure 15:
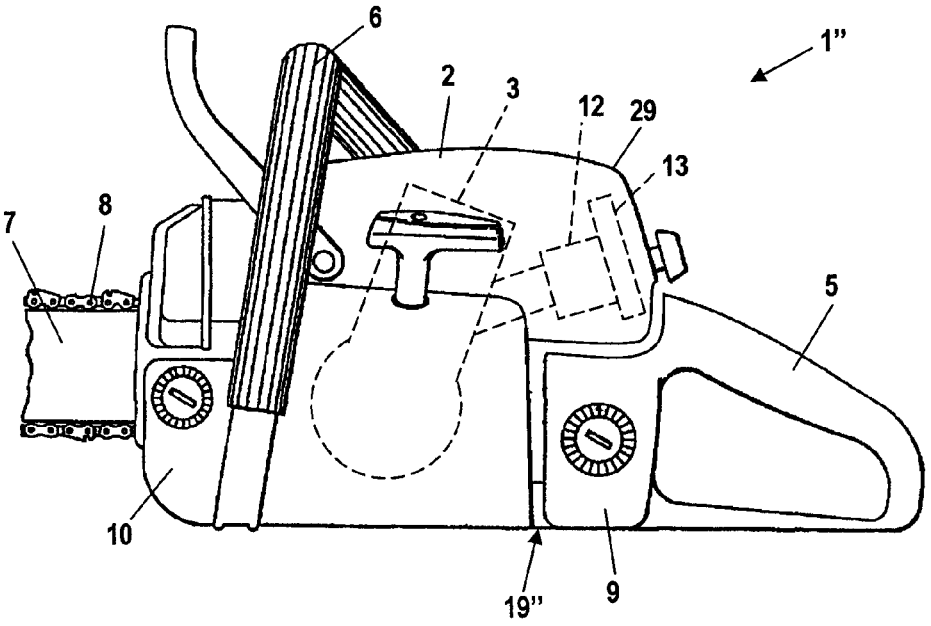
FIG. 15 is a second embodiment of a hand-held power tool in a schematic side view

FIGS. 14 and 15 show embodiments of the motor chainsaw 1 with modified arrangements of the vibration gap. The motor chainsaw 1' illustrated in FIG. 14 has a vibration gap 19'. On one side of the vibration gap 19' the housing 2 and the drive motor 3, the guide bar 7, and the saw chain 8 are arranged. On the other side of the vibration gap 19', the rear handle 5 and the grip pipe 6, the fuel tank 9, and the carburetor 12 are arranged. The fuel tank 9 and the carburetor 12 are thus vibration-decoupled from the drive motor 3. In this configuration no lines must be extended across the vibration gap 19'.

In the embodiment illustrated in FIG. 15, a vibration gap 19" is provided. On one side of the vibration gap 19" the housing 2 with the drive motor 3, the guide bar 7, the saw chain 8 and carburetor 12 are arranged. The fuel tank 9, the rear handle 5, and the grip pipe 6 are decoupled from these parts by means of the vibration gap 19" and appropriate antivibration elements. In this configuration the fuel line 14 must extend across the vibration gap 19". The venting valve can be secured on the fuel tank 9 or on the rear handle 5 so that the venting line 15 must not extend across the vibration gap 19". In the embodiment according to FIG. 15 it is alternatively possible to arrange the carburetor 12 so as to be vibration-decoupled from the drive motor 3. The carburetor 12 is then vibration-decoupled from the fuel tank 9 as well as from the drive motor 3. In these embodiments of the motor chainsaw 1, a configuration of the connecting member as described in connection with FIGS. 1 to 13 is advantageous.

The specification incorporates by reference the entire disclosure of German priority document 10 2007 022 116.0 having a filing date of May 11, 2007.

While specific embodiments of the invention have been shown and described in detail to illustrate the inventive principles, it will be understood that the invention may be embodied otherwise without departing from such principles.

What is claimed is:

1. A hand-held power tool comprising:

at least one operating medium tank having at least one opening communicating with the interior of the operating medium tank;

at least one connecting conduit arranged external to the operating medium tank;

at least one connecting member inserted into the opening, wherein the at least one connecting conduit is connected to the at least one connecting member;

first securing means that secure a rotational position of the at least one connecting member in the opening, wherein the first securing means comprise a first securing element monolithically formed together with the at least one connecting member and a second securing element in the form of wall sections monolithically formed together with the operating medium tank, wherein between the wall sections a receptacle is formed, and wherein the first securing element projects into and positive-lockingly engages the receptacle and prevents rotation of the at least one connecting member relative to the opening.

2. The power tool according to claim 1, wherein the at least one connecting conduit is a shaped hose.

3. The power tool according to claim 1, wherein the at least one connecting conduit is pushed onto a connecting socket of the at least one connecting member and wherein the at least one connecting member has second securing means that secure a rotational position of the at least one connecting conduit on the connecting socket.

4. A hand-held power tool, comprising:

at least one operating medium tank having at least one opening communicating with the interior of the operating medium tank;

at least one connecting conduit arranged external to the operating medium tank;

at least one connecting member inserted into the opening, wherein the at least one connecting conduit is connected to the at least one connecting member;

securing means that secure a rotational position of the at least one connecting member in the opening;

a seal arranged in the opening, wherein the at least one connecting member is inserted into the seal and wherein the at least one connecting member forces the seal against a rim of the opening;

wherein the securing means comprises a first positional securing device that secures positive-lockingly the at least one connecting member on the seal to prevent rotation of the at least one connecting member relative to the seal;

wherein the securing means comprises a second positional securing device that secures the seal relative to the operating medium tank positive-lockingly to prevent the seal from rotating in the opening;

wherein the first and second positional securing devices prevent a rotation of the at least one connecting member relative to the opening.

5. The power tool according to claim 4, further comprising a line section, wherein the line section and the seal are together monolithically formed, and wherein the line section extends into an interior of the operating medium tank.

6. The power tool according to claim 5, further comprising a suction head connected to an end of the line section opposite the seal.

7. The power tool according to claim 5, wherein the line section is a shaped hose.

8. A hand-held power tool comprising:

at least one operating medium tank having at least one opening communicating with the interior of the operating medium tank;

at least one connecting conduit arranged external to the operating medium tank;

at least one connecting member inserted into the opening, wherein the at least one connecting conduit is connected to the at least one connecting member;

first securing means that secure a rotational position of the at least one connecting member in the opening, wherein the first securing means comprise a first securing element integrally formed on the at least one connecting member and a second securing element in the form of wall sections integrally formed on the operating medium tank, wherein between the wall sections a receptacle is formed, and wherein the first securing element positive-lockingly engages the receptacle and prevents rotation of the at least one connecting member relative to the opening;

wherein the at least one connecting conduit is a fuel line connected to a carburetor of the power tool.

9. A hand-held power tool comprising:

at least one operating medium tank having at least one opening communicating with the interior of the operating medium tank;

at least one connecting conduit arranged external to the operating medium tank;

at least one connecting member inserted into the opening, wherein the at least one connecting conduit is connected to the at least one connecting member;

first securing means that secure a rotational position of the at least one connecting member in the opening, wherein the first securing means comprise a first securing element integrally formed on the at least one connecting member and a second securing element wherein the first and second securing elements positive-lockingly engage one another and prevent rotation of the at least one connecting member in the opening;

wherein the at least one connecting conduit is a venting line connected to a venting valve of the power tool.

10. The power tool according to claim 9, wherein the venting valve is arranged in a grip housing of the power tool, wherein the grip housing is separated by a vibration gap from the operating medium tank.

11. A hand-held power tool comprising:

at least one operating medium tank having at least one opening communicating with the interior of the operating medium tank;

at least one connecting conduit arranged external to the operating medium tank;

at least one connecting member inserted into the opening, wherein the at least one connecting conduit is connected to the at least one connecting member;

first securing means that secure a rotational position of the at least one connecting member in the opening, wherein the first securing means comprise a first securing element integrally formed on the at least one connecting member and a second securing element in the form of wall sections integrally formed on the operating medium tank, wherein between the wall sections a receptacle is formed, and wherein the first securing element positive-lockingly engages the receptacle and prevents rotation of the at least one connecting member relative to the opening;

wherein the at least one connecting conduit is a purge line connected to a scavenging pump of the power tool.

12. The power tool according to claim 9, wherein a first one of the at least one connecting member is provided for a fuel line of the power tool and a second one of the at least one connecting member is provided for a venting line of the power tool.

13. The power tool according to claim 12, wherein said second one of the at least one connecting member has a first connecting socket for the venting line of the power tool and a second connecting socket for a purge line of the power tool.

14. The power tool according to claim 1, wherein the at least one connecting member is a common connecting member for a fuel line of the power tool and for a venting line of the power tool.

15. A hand-held power tool comprising:

at least one operating medium tank having at least one opening communicating with the interior of the operating medium tank;

at least one connecting conduit arranged external to the operating medium tank;

at least one connecting member inserted into the opening, wherein the at least one connecting conduit is connected to the at least one connecting member;

first securing means that secure a rotational position of the at least one connecting member in the opening, wherein the first securing means comprise a first securing element integrally formed on the at least one connecting member and a second securing element in the form of wall sections integrally formed on the operating medium tank, wherein between the wall sections a receptacle is formed, and wherein the first securing element positive-lockingly engages the receptacle and prevents rotation of the at least one connecting member relative to the opening;

at least one holder for positionally securing the at least one connecting conduit on the power tool.

16. The power tool according to claim 4, wherein the first positional securing device is an upwardly projecting bolt monolithically formed on the seal and wherein the at least one connecting member has a receptacle in which receptacle the bolt is received.

17. The power tool according to claim 4, wherein the second positional securing device is a radially outwardly projecting section of an otherwise circular contact surface of the seal on the operating medium tank and wherein the operating medium tank has an integrally formed wall section interacting with the radially outwardly projecting section.

18. A hand-held power tool comprising:

at least one operating medium tank having at least one opening communicating with the interior of the operating medium tank;

at least one connecting conduit arranged external to the operating medium tank;

at least one connecting member inserted into the opening, wherein the at least one connecting conduit is connected to the at least one connecting member;

securing means that secure a rotational position of the at least one connecting member in the opening;

wherein the securing means comprise a first securing element arranged on the at least one connecting member, wherein the first securing element comprises at least one stay that is monolithically formed together with the at least one connecting member;

wherein the securing means comprises a second securing element arranged on the operating medium tank, wherein the second securing element is a wall section that is monolithically formed together with the operating medium tank;

wherein the at least one stay is resting at least partially against the wall section so that the rotational position of the at least one connecting memberis secured and a rotation of the at least one connecting member relative to the opening is prevented.

19. The power tool according to claim 18, wherein the first securing element comprises two stays that are arranged on opposed sides of the wall section.

* * * * *